United States Patent [19]

Oka

[11] 4,409,309

[45] Oct. 11, 1983

[54] ELECTROPHOTOGRAPHIC LIGHT-SENSITIVE ELEMENT

[75] Inventor: Kozo Oka, Kanagawa, Japan

[73] Assignee: Fuji Xerox Co., Ltd., Tokyo, Japan

[21] Appl. No.: 288,865

[22] Filed: Jul. 31, 1981

[30] Foreign Application Priority Data

Jul. 31, 1980 [JP] Japan ..... 55-104317
Feb. 3, 1981 [JP] Japan ..... 56-13779

[51] Int. Cl.[3] ..... G03G 5/08; G03G 5/06

[52] U.S. Cl. ..... 430/65; 430/66; 430/67

[58] Field of Search ..... 430/65–67

[56] References Cited

U.S. PATENT DOCUMENTS 3,816,117 6/1974 Kaukeinen ..... 430/66
3,997,343 12/1976 Weigl et al. ..... 430/67
4,134,763 1/1979 Fujimura et al. ..... 430/66
4,148,637 4/1979 Kubota et al. ..... 430/66
4,304,626 12/1981 Shaw et al. ..... 430/65

*Primary Examiner*—Bernard D. Pianalto
*Attorney, Agent, or Firm*—Sughrue, Mion, Zinn, Macpeak, and Seas

[57] ABSTRACT

An electrophotographic light-sensitive element which is useful in the Carlson electrophotographic process is disclosed, comprising an electrically conductive support having provided thereon a photoconductive layer and a protective layer wherein said protective layer has a thickness of from 1 to 30 μm and contains a powder of a metal oxide having a volume intrinsic resistance of $10^{11}$ Ω·cm or less and a mean particle size of 0.3 μm or less dispersed in a binder resin.

21 Claims, No Drawings

ELECTROPHOTOGRAPHIC LIGHT-SENSITIVE ELEMENT

FIELD OF THE INVENTION

This invention relates to an electrophotographic light-sensitive element, and more particularly, to an electrophotographic light-sensitive element comprising an electrically conductive support having laminated thereon, in sequence, a photoconductive layer and a protective layer, which is useful in the electrophotographic process known as the Carlson process.

BACKGROUND OF THE INVENTION

Electrophotographic light-sensitive elements which have hitherto been used include those comprising an electrically conductive support having vapor-deposited or coated thereon as a light-sensitive layer Se, Se-Te alloy, or Se-As alloy, or an organic photoconductor such as PVK (polyvinyl carbazole)-TNF (2,4,7-trinitrofluorenone). However, when these known elements are repeatedly used, they tend to be damaged due to peeling of a transfer paper or cleaning of residual toner on the light-sensitive layer, or the light-sensitive layer tends to be worn away, and, therefore, the elements must be replaced with new ones within a relatively short period of time, before the electrophotographic characteristics are degraded. In order to overcome such defects, it has been known in the art that a protective layer can be provided on the surface of the light-sensitive element. One type of such protective layer is an electrically insulating surface layer composed of a highly electrically insulating material. Such an electrically insulating surface layer has advantages such as that the thickness can be increased and that those having high mechanical strength can be chosen. However, in order to repeatedly use a light-sensitive element with this type of protective layer, a specific latent image-formation process, (for example; (A) a first charging, a second charging with an opposite polarity to that of the first charging, and imagewise exposure; or (B) a first charging, a second charging with opposite polarity while simultaneous imagewise exposing, and uniform exposure) is required. Furthermore, such a process requires two or more charging steps in one copying operation, and thus the apparatus to be used is necessarily complicated. This may result in electrophotographic characteristics that are instable, and the cost is high. Another type of protective layer is a surface layer useful in the so-called Carlson process, which does not require the above-described specific latent image-formation process, and in which a simple operation of charging and imagewise exposure is carried out. The protective layer should be rendered less electrically insulative to prevent accumulation of charges into its surface or interior. A method which has hitherto been employed for this purpose is to add a quaternary ammonium salt or the like to the protective layer. Such materials generally greatly change in conductivity by moisture absorption, and the conductivity of the protective layer reduces when drying, whereby charges accumulate and result in fogging of the image. Further, in high moisture conditions, the conductivity excessively increases, and transfer of the charges in a longitudinal direction takes place, whereby fading of the image tends to occur. In addition, the conventional protective layer must be relatively thin, to the extent of several microns or less, for purposes of use in the Carlson process. Such protective layers are hardly satisfactory in mechanical strength, and are colored by substances added for the purpose of lowering the electrical insulation properties, and thus undesirable influences on the spectral sensitivity of the light-sensitive element occur.

An attempt to control the conductivity of the protective layer has been made, in which an electrically conductive powder is dispersed in a binder resin as described, for example, Japanese Patent Application (OPI) No. 3338/1978. In this case, when carbon or a metal is dispersed, light absorption is strong, and therefore, it is difficult to increase the conductivity while maintaining the transparency.

SUMMARY OF THE INVENTION

An object of this invention is to provide a light-sensitive element containing a protective layer useful in the Carlson process which is free from accumulation of charges by repeated use, stable against changing environmental condition and relatively thick in thickness, and has desirable optical properties, and which can overcome the drawbacks of the conventional products.

As the result of extensive investigations, it has been found that a protective layer containing a powder of metal oxide having a mean particle size of 0.3 μm or less dispersed in a binder resin is substantially transparent in an applied thickness. Thus, the above-described drawbacks can be overcome by use of an electrophotographic light-sensitive element comprising an electrically conductive support having provided thereon, in sequence, a photoconductive layer and a protective layer, optionally with a charge-injection inhibiting layer interposing between the above-described two layers, wherein the protective layer is a layer having a thickness of from 1 to 30 μm and containing a powder of metal oxide having a volume intrinsic resistance of $10^{11}$ Ω·cm or less and a mean particle size of 0.3 μm or less dispersed in a binder resin.

DETAILED DESCRIPTION OF THE INVENTION

Any metal oxide powder can be used in the present invention provided that the powder has a volume intrinsic resistance of $10^{11}$ Ω·cm or less, and a mean particle size of 0.3 μm or less. It is preferred that the powder has substantially no absorption to visible light (wavelength; about 0.45 μm to about 0.72 μm), i.e., assuming a white or gray color. Examples of the metal oxide include zinc oxide, titanium oxide, tin oxide, bismuth oxide, indium oxide, antimony oxide, etc. Two or more metal oxides may also be used as a mixture thereof. The metal oxide powder having a mean particle size of 0.15 μm or less, more particularly 0.1 μm or less is preferably used in the present invention. The term "mean particle size" used herein means a number average particle size excluding particles having a particle size of 0.01 μm or less.

Even if powders have no-absorption to visible light, such as zinc oxide or titanium oxide, when the powders have a mean particle size of more than 0.3 μm are dispersed, the refractive index becomes non-uniform though no light absorption takes place, and the light transmitted through the layer is strongly dispersed so that the image becomes cloudy, resulting in reduction of resolution powder upon copying. The above light-diffusion phenomenone does not take place using a powder having a mean particle size of 0.3 μm or less, whereby the reduction of resolution power can be eliminated.

In one preferred embodiment of the present invention, the powder consists essentially of tin oxide and antimony oxide and has a mean particle size of 0.15 μm or less and preferably 0.10 μm or less. When such ultrafine powder is used, a highly light-transparent protective layer can be obtained, resulting in excellent resolution power.

The powder consisting essentially of tin oxide and antimony oxide means a powder in which tin oxide and antimony oxide are copresent in a single powder, such as a powder in which an antimony oxide fine powder is melt-adhered onto the surface of a tin oxide fine powder, a powder of solid solution of tin oxide and antimony oxide, and the like. However, the invention is not to be construed as being limited to these specific preferred examples. Such a powder can be obtained by, for example, mixing predetermined amounts of tin chloride and antimony chloride, hydrolyzing the mixture to convert it to a mixture of tin oxide and antimony oxide, washing, and then calcining at about 500° C., followed by grinding. A suitable proportion of tin oxide to antimony oxide in the single powder is in the range of from 98:2 to 70:30 by weight.

As the binder resin which can be used for the protective layer of this invention, those which are substantially transparent to visible light and excellent in electric insulation (more than $10^{13}$ Ω·cm), mechanical strength, and adhesiveness are preferred. Examples include polyester resins, polycarbonate resins, polyurethane resins, epoxy resins, acryl resins, vinyl chloride-vinyl acetate copolymers, silicone resins, alkyd resins, polyvinyl chloride resins, cyclic butadiene rubbers, fluorocarbon resins and the like. When solvent resistance of the protective layer is required, it is desirable to use a hardenable resin. Polyurethane resins are optimal as the binder resin used for the protective layer of this invention. Suitable examples of the polyurethane resins include acryl-based polyurethanes, polyester-based polyurethanes, etc.

The amount of the metal oxide powder to be dispersed in the binder resin varies depending upon the particular combination of the powder and the binder resin, but it is generally from 5 to 70% by weight, preferably from 10 to 40% by weight, based on the total weight of the protective layer.

The protective layer of this invention has an intrinsic resistance of from $10^{14}$ Ω·cm to $10^{9}$ Ω·cm, preferably from $10^{13}$ Ω·cm to $10^{11}$ Ω·cm.

A suitable thickness of the protective layer is in the range of from 1 to 30 μm, and preferably from 3 to 15 μm.

The protective layer is thermally and chemically stable, and its characteristics are not significantly affected by environmental changes. It is excellent in durability, and its characteristics do not substantially change with time. Further, it is excellent in mechanical strength properties, such as abrasion resistance, etc.

Photoconductive layers which can be used in this invention include a vapor deposited film of Se, Se-Te alloy, Se-As alloy, Se-Sb alloy or Se-Bi alloy, a layer having an organic photoconductor such as PVK/TNF or an inorganic photoconductor such as ZnO or CdS dispersed in a binder, and a laminate of a charge generation layer and a charge transport layer. In particular, it is surprising that according to this invention a photoconductor which is too weak in mechanical strengths for use in conventional electrophotography can be used herein.

In this invention, since photogeneration of a charge carrier is carried out in the photoconductive layer, the protective layer must be substantially transparent in wavelength regions of lights to which the photoconductive layer is sensitive. Further, the electrophotographic light-sensitive element of this invention must be constituted to form an interface capable of inhibiting charge-injection i.e., a barrier interface, between the protective layer and the photoconductive layer in order to prevent disappearance of surface charges occurred by uniform charging due to charge-injection into the photoconductive layer. In this invention an intermediate layer can be optionally provided bearing between the protective layer and the photoconductive layer, to thereby improve the charge trap.

This intermediate layer must be higher in electrical resistance than the protective upper layer. The intermediate layer may have a function as an adhesive layer for the photoconductive layer and the protective layer in addition to serving as a charge-injection inhibiting layer, i.e., a barrier layer. Suitable materials which can be used for the intermediate layer are typically composed of, as a major component, a polymeric compound, or an inorganic compound.

Examples of the polymeric compound include epoxy resins, polyester resins, polyamide resins, polyurethane resins, pyroxyline, vinylidene chloride resins, silicone resins, fluorocarbon resins and the like. These can be used alone or as a mixture of two or more thereof. The intermediate layer can be formed by various coating methods such as spray coating, dip coating, knife coating, roll coating, etc.

For the intermediate layer including an inorganic compound as a major component, suitable examples are those exhibiting a high electric resistance, at least in a dark place, such as $SiO_2$, Se, S, $As_2O_3$, etc. The thickness must be in such range that the irradiated light can be transmitted therethrough to reach the photoconductive layer. If a colored material is used, the layer is required to be thin, but it has been confirmed that even if Se is about 100 Å in thickness, remarkable reduction of dark decay can be obtained. The addition of small amounts of additives such as As, Sb, Bi, Te, etc. to the Se will give rise to improvements in sensitivity or crystallization preventing effects. Further, the addition of halogen elements will result in improvements in residual potential. In this case, the concentration of the additives must be 20% by weight or less, preferably 15% by weight or less. If it exceeds 20%, then the reduction of dark decay cannot be attained. The formation of such an intermediate layer can be conducted by various conventional method, such as vacuum deposition, sputtering, ion-implanting and the like.

The thickness of the intermediate layer is not critical, but is preferably 3 μm or less, and most preferably 1 μm or less.

The light-sensitive element according to this invention is fundamentally different from those hitherto known as being of laminate type, i.e., one comprising an electrically conductive support having laminated thereon a photoconductive layer consisting of a charge generation layer and a charge transport layer. Particularly, in the light-sensitive element of this invention, a charge pattern is formed between the protective layer/-photoconductive boundary and the electrically conductive support. On the other hand, in the conventional laminate-type light-sensitive element the charge pattern is formed between the charge transport layer surface and the electrically conductive substrate. Furthermore, there are additional differences therebetween. Particularly, (1) in the protective layer the charges must be injected from the protective layer surface into the protective layer/photoconductive boundary, whereas in the charge transport layer the charges must be retained on the surface; and (2) the protective layer is thin as compared to the photoconductive layer, such that a sufficient potential can be generated between the light place and the dark place, whereas the charge transport layer must be thicker than the charge generation layer. Thus, differences in layer function and boundary properties are required.

An electrophotographic light-sensitive element of this invention have various advantages as listed below, as compared to conventional electrophotographic elements.

(1) it has a surface layer capable of forming a latent image without using the aforesaid specific latent image-formation process;

(2) even when the light-sensitive element has been repeatedly used, accumulation and increase of the residual charges does not occur to any significant extent;

(3) the element is not significantly influenced by temperature and moisture;

(4) the thickness of a protective layer can be relatively thick;

(5) a protective layer which does not substantially influence sensitivity of the photoconductive layer can be provided; and (6) a protective layer having high mechanical strength properties can be provided.

This invention will be explained in more detail by reference to the following Examples.

EXAMPLE 1

100 Parts by weight of a polyurethane resin (Retan 4000, a product of Kansai Paint Co., Ltd.), 65 parts by weight of a zinc oxide fine powder having a mean particle size of 0.08 μm, and 100 parts by weight of toluene was charged into a ball mill, and these were mixed and dispersed for 65 hours. The resulting dispersion was spray coated in a thickness of 7 μm (dry) on a 60 μm thick vapor-deposited Se film to thereby form a light-sensitive element having a protective layer on the surface. The protective layer was substantially transparent. Using the thus formed element, steps of positive charging, imagewise exposure, development, transferring, and then cleaning were repeated, whereby copy images having good quality were obtained.

EXAMPLE 2

100 Parts by weight of a zinc oxide powder, 20 parts by weight of a polyurethane resin (Acrydic A808, a product of Dai Nippon Ink Co., Ltd.), 0.1 parts by weight of Rose Bengal, 100 parts by weight of toluene and 10 parts by weight of ethyl alcohol were charged into a ball mill and these were mixed and dispersed for 10 hours. The resulting dispersion was dip coated in a thickness of 20 μm (dry) on an aluminum sheet to thereby form a light-sensitive layer. Separately, 100 parts by weight of an epoxy silicone resin (SR 2115, a product of Tohre Silicone Co., Ltd.), 60 parts by weight of tin oxide ($SnO_2$) fine powder having a mean particle size of 0.05 μm and 100 parts by weight of cellosolve acetate were charged into a ball mill and these were mixed and dispersed for 65 hours. The thus obtained dispersion was spray coated in a thickness of 5 μm (dry) on the previously formed ZnO light-sensitive layer to thereby form a light-sensitive element having a protective layer on the surface. The protective layer was substantially transparent. Using the thus formed element, steps of negative charging, imagewise exposure, development, and then cleaning, were repeated, whereby copy images having good quality were obtained.

EXAMPLE 3

A polyamide resin (VERSALON 1175, a product of Japan Henkel Co.) was spray coated to form an intermediate layer between the Se photoconductive layer and the protective layer as used in Example 1 in a thickness of 0.3 μm (dry). Using the resulting light-sensitive element, copying was repeated. As a result, copy images having a high image density and a high quality as compared to that obtained in Example 1 were obtained.

EXAMPLE 4

100 Parts by weight of a polyurethane resin (Retan 4000, a product of Kansai Paint Co., Ltd.), 30 parts by weight of a tin oxide powder onto which 15 wt.% of antimony oxide had been melt-adhered, and 100 parts by weight of cellosolve acetate were charged into a ball mill, and these were mixed and dispersed for 90 hours. The resulting dispersion was spray coated in a thickness of 7 μm (dry) on a photoconductive layer prepared by vapor depositing Se onto an Al pipe in a thickness of 60 μm, to thereby form a light-sensitive element. Using the thus formed element, steps of positive charging, imagewise exposure, development, transferring, and then cleaning were repeated, whereby copy images having good quality were obtained.

EXAMPLE 5

A polyamide resin (VERSALON 1175, a product of Japan Henkel Co.) was spray coated to form an intermediate layer between the Se photoconductive layer and the protective layer as used in Example 4 in a thickness of 0.4 μm. Thus, a light-sensitive element was obtained. Using thus obtained element, the copying was repeated. As the result, copy images having an even higher image density and quality as compared to the results obtained in Example 4 were obtained.

COMPARATIVE EXAMPLE

Various electrophotographic light-sensitive elements were prepared in the same manner as in Example 1, except that electroconductive powders shown in the table below were dispersed in the binder resin, respectively.

Electrophotographic characteristics of each element was measured, and the results are shown in the table. When the highly conductive carbon black or cupper was dispersed in the binder resin, the resulting protective layer colored to a great extent, so that the relative sensitivity markedly reduced. Further, when the ZnO or $TiO_2$ powder having a mean particle size of more than 0.3 μm was dispersed, the resolving power was low, while an electrophotographic light-sensitive element is generally required to have resolution power of at least 5 lines/mm.

TABLE

| Electroconductive Powder | Mean Particle Size (μm) | Content of Powder (wt %) | Thickness of Protective Layer (μm) | Electrophotographic Characteristics | |
|---|---|---|---|---|---|
| | | | | Relative Sensitivity* | Resolution Power (line/mm) |
| Highly conductive carbon black | 1 | 5 | 3 | 0.005 | ** |
| Copper | 1.5 | 0.5 | 3 | 0.02 | ** |
| Zinc oxide | 1 | 30 | 7 | 0.9 | 2 |
| Tin oxide | 0.4 | 35 | 5 | 0.9 | 4 |
| Zinc oxide | 0.08 | 30 | 7 | 0.9 | 6 |
| Tin oxide | 0.05 | 35 | 5 | 0.9 | 6 |
| Solid solution of tin oxide-antimony oxide | 0.15 | 30 | 7 | 0.9 | 6 |
| Zinc Oxide | 0.3 | 30 | 7 | 0.8 | 6 |

*Relative value of a reciprocal of an exposure amount necessary to decrease the potential of the element to 100 V by uniform exposure after charging the element at 800 V, based on that of an element of Example 1 without the protective layer as 1.
**Not measured because of extremely low sensitivity.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive element comprising an electrically conductive support having provided thereon, in sequence, a photoconductive layer and a protective layer, wherein said protective layer has a thickness of from 1 to 30 μm and contains a powder of a metal oxide having a volume intrinsic resistance of $10^{11}$ Ω·cm or less in an amount of from 10 to 40% by weight based on the total weight of the protective layer and a mean particle size of 0.3 μm or less dispersed in a binder resin, said protective layer being substantially transparent in wavelength regions of light to which said photoconductive layer is sensitive.

2. An electrophotographic light-sensitive element as in claim 1, wherein said protective layer is substantially transparent to light in the wavelength of from about 0.45μ to about 0.72μ.

3. An electrophotographic light-sensitive element comprising an electrically conductive support having provided thereon, in sequence, a photoconductive layer, a barrier layer and a protecitve layer, wherein said protective layer has a thickness of from 1 to 30 μm and contains a powder of a metal oxide having a volume intrinsic resistance of $10^{11}$ Ω·cm or less and a mean particle size of 0.3 μm or less dispersed in a binder resin, said protective layer being substantially transparent in wavelength regions of light to which said photoconductive layer is sensitive, wherein said barrier layer has a higher electric resistance than said protective layer.

4. An electrophotographic light sensitive-element as in claim 1 or 3, wherein said metal oxide is selected from the group consisting of zinc oxide, titanium oxide, tin oxide, bismuth oxide, indium oxide, and antimony oxide.

5. An electrophotographic light-sensitive element as in claim 1 or 3, wherein said powder has a mean particle size of 0.15 μm or less.

6. An electrophotographic light-sensitive element as in claim 1 or 3, wherein said binder resin is selected from the group consisting of polyester resins, polycarbonate resins, polyurethane resins, epoxy resins, acryl resins, vinyl chloride-vinyl acetate copolymers, silicone resins, alkyd resins, polyvinyl chloride resins, cyclic butadiene rubbers, and fluorocarbon resins.

7. An electrophotographic light-sensitive element as in claim 6, wherein said binder resin is a polyurethane resin.

8. An electrophotographic light-sensitive element as in claim 1 or 3, wherein the thickness of said protective layer is from 3 to 15 μm.

9. An electrophotographic light-sensitive element as in claim 1 or 3, wherein said protective layer has an intrinsic resistance of from $10^{13}$ Ω·cm to $10^{11}$ Ω·cm.

10. An electrophotographic light-sensitive element as in claim 1 or 3, wherein said powder has a mean particle size of 0.10 μm or less.

11. An electrophotographic light-sensitive element as in claim 3, wherein said powder is present in an amount of from 10 to 40% by weight based on the total weight of the protective layer.

12. An electrophotographic light-sensitive element as in claim 3, wherein said protective layer is substantially transparent to light in the wavelength of from about 0.45μ to about 0.72μ.

13. An electrophotographic light-sensitive element comprising an electrically conductive support having provided thereon, in sequence, a photoconductive layer and a protective layer, wherein said protective layer has a thickness of from 1 to 30 μm and contains a powder of a metal oxide having a volume intrinsic resistance of $10^{11}$ Ω·cm or less dispersed in a binder resin, said protective layer being substantially transparent in wavelength regions of light to which said photoconductive layer is sensitive and said powder consisting essentially of tin oxide and antimony oxide in the form of a single powder having a mean particle size of 0.15 μm or less.

14. An electrophotographic light sensitive element as in claim 13, wherein the weight ratio of tin oxide/antimony oxide in said powder is in the range of from 98/2 to 70/30.

15. An electrophotographic light-sensitive element as in claim 13, wherein said powder is present in an amount of from 10 to 40% by weight based on the total weight of the protective layer.

16. An electrophotographic light-sensitive element as in claim 13, wherein said protective layer is substantially transparent to light in the wavelength of from about 0.45μ to about 0.72μ.

17. An electrophotographic light-sensitive element comprising an electrically conductive support having provided thereon, in sequence, a photoconductive layer, a barrier layer and a protective layer, wherein said protective layer has a thickness of from 1 to 30 μm and contains a powder of a metal oxide having a volume intrinsic resistance of $10^{11}$ Ω·cm or less dispersed in a binder resin, said protective layer being substantially transparent in wavelength regions of light to which said photoconductive layer is sensitive and said powder consisting essentially of tin oxide and antimony oxide in the form of a single powder having a mean particle size of 0.15 μm or less and wherein said barrier layer has a higher electric resistance than the said protective layer.

18. An electrophotographic light-sensitive element as in claim 17, wherein said powder is present in an amount of from 10 to 40% by weight based on the total weight of the protective layer.

19. An electrophotographic light-sensitive element as in claim 17, wherein the weight ratio of tin oxide/antimony oxide in said powder is in the range of from 98/2 to 70/30.

20. An electrophotographic light-sensitive element as in claim 17, wherein said protective layer is substantially transparent to light in the wavelength of from about 0.45μ to about 0.72μ.

21. In an electrophotographic process for forming a electrostatic latent image on a light-sensitive element comprising an electrically conductive support having provided thereon, in sequence, a photoconductive layer and a protective layer, which comprises uniformly charging and image-wise exposing to light said element from the protective layer side, wherein said protective layer has a thickness of from 1 to 30 μm and contains a powder of a metal oxide having a volume intrinsic resistance of $10^{11}$ Ω·cm or less in an amount of from 10 to 40% by weight based on the total weight of the protective layer and a mean particle size of 0.3 μm or less dispersed in a binder resin, said protective layer being substantially transparent in wavelength regions of light to which said photoconductive layer is sensitive.

* * * * *